US010081930B1

(12) United States Patent
Zhuo et al.

(10) Patent No.: US 10,081,930 B1
(45) Date of Patent: Sep. 25, 2018

(54) TOUCH SENSITIVE TAP

(71) Applicant: XIAMEN SOLEX HIGH-TECH INDUSTRIES CO., LTD., Xiamen, Fujian (CN)

(72) Inventors: Zhiwei Zhuo, Fujian (CN); Chunjie Hong, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/621,725

(22) Filed: Jun. 13, 2017

(30) Foreign Application Priority Data

Mar. 15, 2017 (CN) ..... 2017 1 0152715

(51) Int. Cl.
*E03B 1/00* (2006.01)
*E03C 1/05* (2006.01)
*E03C 1/04* (2006.01)

(52) U.S. Cl.
CPC ..... *E03C 1/055* (2013.01); *E03C 1/0404* (2013.01); *E03C 1/0412* (2013.01); *E03C 1/04* (2013.01); *E03C 1/05* (2013.01); *E03C 2001/0415* (2013.01)

(58) Field of Classification Search
CPC ... E03C 1/0404; E03C 1/055; Y10T 137/9464
USPC ..... 137/315.12, 315.15, 603, 801
See application file for complete search history.

(56) References Cited

U.S. PATENT DOCUMENTS

2007/0069169 A1* 3/2007 Lin ..... E03C 1/0404 251/129.04
2011/0079519 A1* 4/2011 Widler ..... C02F 1/4672 205/743
2012/0266983 A1* 10/2012 Tsai ..... E03C 1/046 137/801
2014/0026980 A1* 1/2014 Esche ..... E03C 1/0404 137/315.01
2015/0308089 A1* 10/2015 Thompson ..... G05D 23/1393 137/78.1
2016/0160481 A1* 6/2016 Lev ..... E03C 1/0404 137/801

* cited by examiner

*Primary Examiner* — Reinaldo Sanchez-Medina
(74) *Attorney, Agent, or Firm* — Rabin & Berdo, P.C.

(57) ABSTRACT

A touch sensitive tap includes a tap main body; a support pipe rotatably assembled to the tap main body and disposed with a touch sensing area for a user to touch; a conductive silicone ring sealingly connecting the tap main body and the support pipe and electrically connecting the tap main body and the support pipe to form an integral conductor therebetween; an outlet portion connected to the support pipe; a waterway at least connected from the tap main body to the support pipe and connected to the outlet portion; and an on-off control portion coupled to the waterway to control opening and closing of the waterway. The integral conductor acquires a touch signal from the touch sensing area and transmits the touch signal to the on-off control portion, and the on-off control portion controls opening and closing of the waterway after receiving the touch signal.

18 Claims, 6 Drawing Sheets

TOUCH SENSITIVE TAP

FIELD OF THE INVENTION

The present invention relates to a tap, particularly to a touch sensitive tap.

BACKGROUND OF THE INVENTION

In the current market, the touch sensitive tap comprises a tap main body, a support pipe, an outlet portion, a waterway and an on-off control portion. The support pipe is rotatably installed on the tap main body, and the outlet portion is connected to the support pipe. The waterway is at least connected from the main body to the support pipe and is connected to the outlet portion. The support pipe has a touch sensing area for the user to touch; the on-off control portion is installed below the tap main body. The on-off control portion can control the waterway to turn on and off after receiving the touch signal. In order to seal the rotational connection of the tap main body and the support pipe, and have a better rotating feeling, it is necessary to provide a plastic element or a rubber element between the tap main body and the support pipe to make the two not directly contact. In order to realize the electrical connection between the touch area and the on-off control portion, the touch sensitive tap on the existing market use the following two ways: 1. The connection method between the tap main body and the support pipe is capacitive coupling. The support pipe transmits the signal to the tap main body, then the tap main body transmits the signal to the on-off control portion. It has the following deficiencies: The sensitivity of the touch area on the support pipe is low, even a touch failure may occur. 2. A conductive metal element or a rigid electronic element is provided between the support pipe and the tap main body to realize the direct electrical conduction of the tap main body and the support pipe. The support pipe transmits the signal to the tap main body through the metal element or the rigid electronic element, then the tap main body transmits the signal to the on-off control portion. It has the following deficiencies: the cost and difficulty of installation is increased, and the support pipe will scrap and make noise during the process of rotation, because the dielectric (metal element or rigid electronic element) is a rigid material.

SUMMARY OF THE INVENTION

The present invention provides a touch sensitive tap, which overcome the deficiencies of the touch sensitive tap mentioned in background of the invention.

The technical scheme adopted by the present invention to solve the technical problem are:

The touch sensitive tap, comprising a tap main body, a support pipe, an outlet portion, a waterway and an on-off control portion; the support pipe is rotatably assembled to the tap main body, the outlet portion is connected to the support pipe, the waterway is at least connected from the tap main body to the support pipe and is connected to the outlet portion, the on-off control portion is coupled to the waterway to control the open and close of the waterway; the support pipe is disposed with a touch sensing area for user to touch, a conductive silicone ring is disposed between the tap main body and the support pipe to connect the tap main body and the support pipe in sealing way, the conductive silicone ring electrically connects the tap main body and the support pipe to form an integral conductor, the integral conductor acquires touch signal from the touch sensing area and transmits the signal to the on-off control portion, the on-off control portion turns on and turns off the waterway after receiving the signal.

The tap main body is disposed with a touch sensing area for user to touch.

The support pipe and the tap main body are made of conductive material, the external surface of the support pipe and the tap main body form the touch sensing area.

It further comprises a signal wire, the signal wire signal connects the tap main body and the on-off control portion.

The outlet portion is fixedly connected to the end opening of the support pipe.

It further comprises a connecting sleeve made of conductive material, the tap main body is disposed with an assembly hole; the connecting sleeve is fixedly connected to one end opening of the support pipe and is disposed with an extending portion, the extending portion is capable of rotatably inserting to the assembly hole of the tap main body, the conductive silicone ring is disposed between the extending portion and the inner wall of the assembly hole of the tap main body.

The assembly hole is a throughout hole; the waterway comprises a water pipe; one end of the water pipe is connected to the outlet of the on-off control portion, the other end passes through the assembly hole of the tap main body and inserts to the support pipe from the end opening thereof and connects to the outlet portion.

The water pipe is a flexible pipe, the outlet portion is detachably assembled to the other end opening of the support pipe.

The pipe body of the water pipe is made of non-conductive material.

The tap main body further comprises a main control valve and a handle controlling the main control valve; hot water inlet of the main control valve is connected to a hot water resource, cool water inlet of the main control valve is connected to a cool water resource, the mixing water outlet of the main control valve is connected to the inlet of the on-off control portion.

Compared with the background of the invention, the technical scheme has the following advantages:

A conductive silicone ring is disposed between the tap main body and the support pipe, so the disadvantages of the background of the invention are overcame, and it brings the following technical effects: firstly, the electrical connection mode of the tap main body and the support pipe is direct coupling, and the tap main body and the support pipe form an integral conductor, thus increasing the sensitivity of the touch sensing area of the support pipe. It can avoid the failure phenomenon that when the touch sensing area of the support pipe is touched. The support pipe and the tap main body has the same sensitivity that improves the user's sense of experience; secondly, the conductive silicone ring connects the tap main body and the support pipe in sealing way, which can prevent the outage of the water from interfering circuit connection through a small gap between the tap main body and the support pipe, enhancing the stability of the circuit used; thirdly, the conductive silicone ring is elastic, it can eliminate the gap between the support pipe and the tap main body. It can also reduce the wobble of the support pipe with respect to the tap main body or avoid the wobble; fourthly, the conductive silicone ring has a certain degree of elastic deformation when it is squeezed by the tap main body and the support pipe, increasing the area of the fitting-surface and frictional resistance, also enhancing the hand feel of the users.

The support pipe and the tap main body are made of conductive material, the external surface of the support pipe and the tap main body form the touch sensing area, so the tough sensing area is large.

The connecting sleeve is fixedly connected to one end opening of the support pipe and is disposed with an extending portion, the extending portion is capable of rotatably inserting to the assembly hole of the tap main body, the conductive silicone ring is disposed between the extending portion and the inner wall of the assembly hole of the tap main body. The assembly is quick and convenient, and the strength of the connection is higher.

DETAILED DESCRIPTION OF THE DRAWINGS

The present invention will be further described with the drawings and the embodiments.

DETAILED DESCRIPTION OF THE EMBODIMENTS

Figure 1:
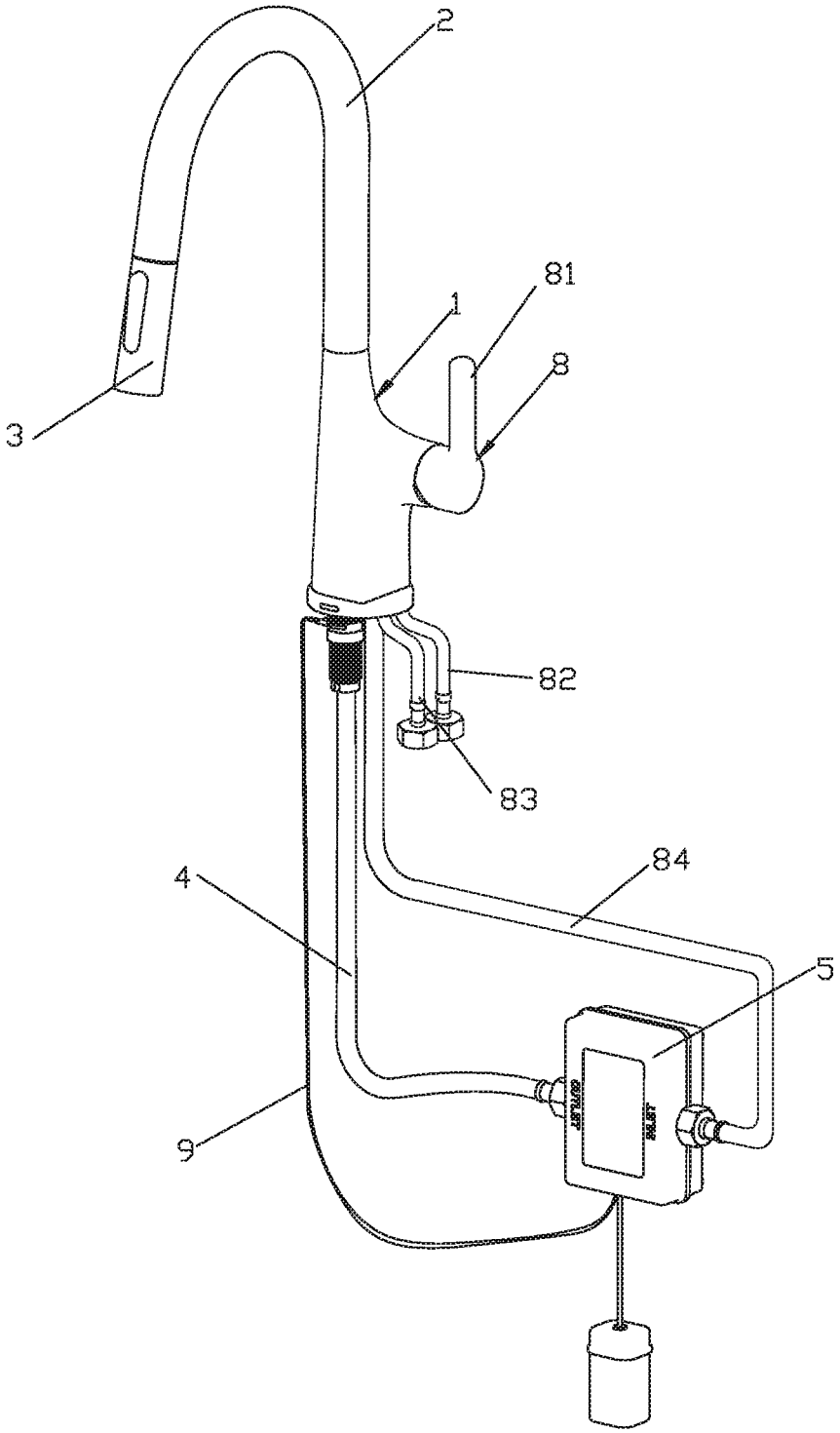
FIG. 1 illustrates a schematic diagram of a tap of a preferred embodiment of the present invention.
Figure 2:
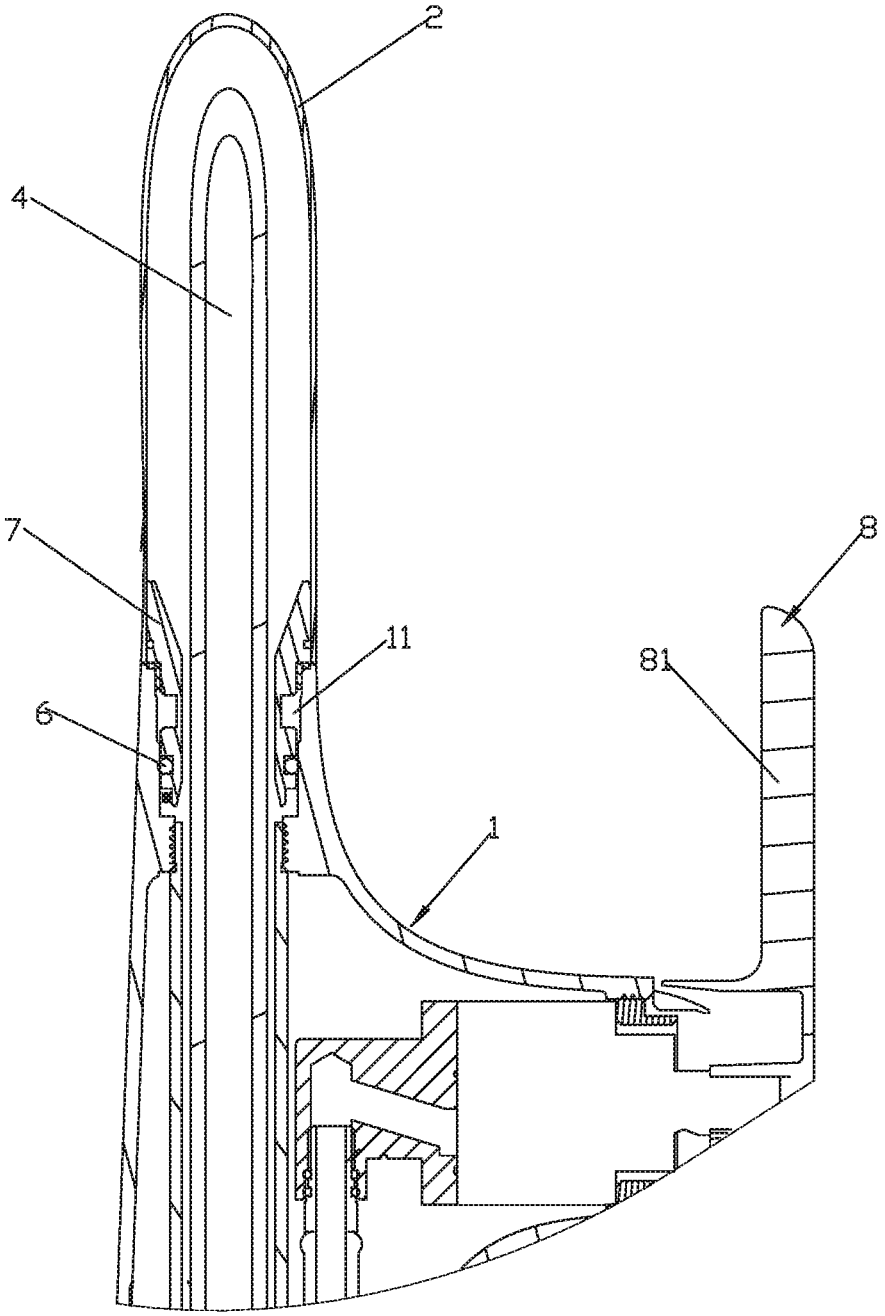
FIG. 2 illustrates a partial sectional diagram of a tap of the preferred embodiment of the present invention.
Figure 3:
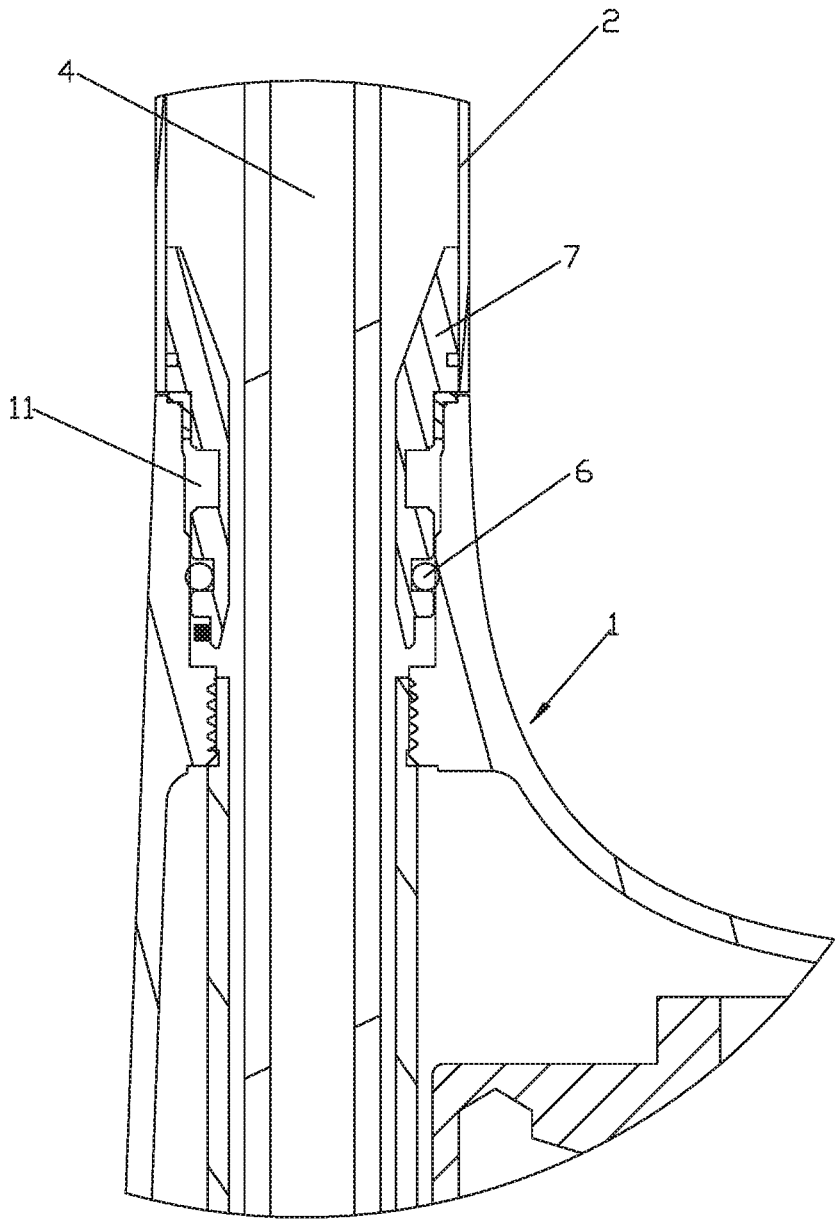
FIG. 3 illustrates a partial magnification diagram of FIG. 2
Figure 4:
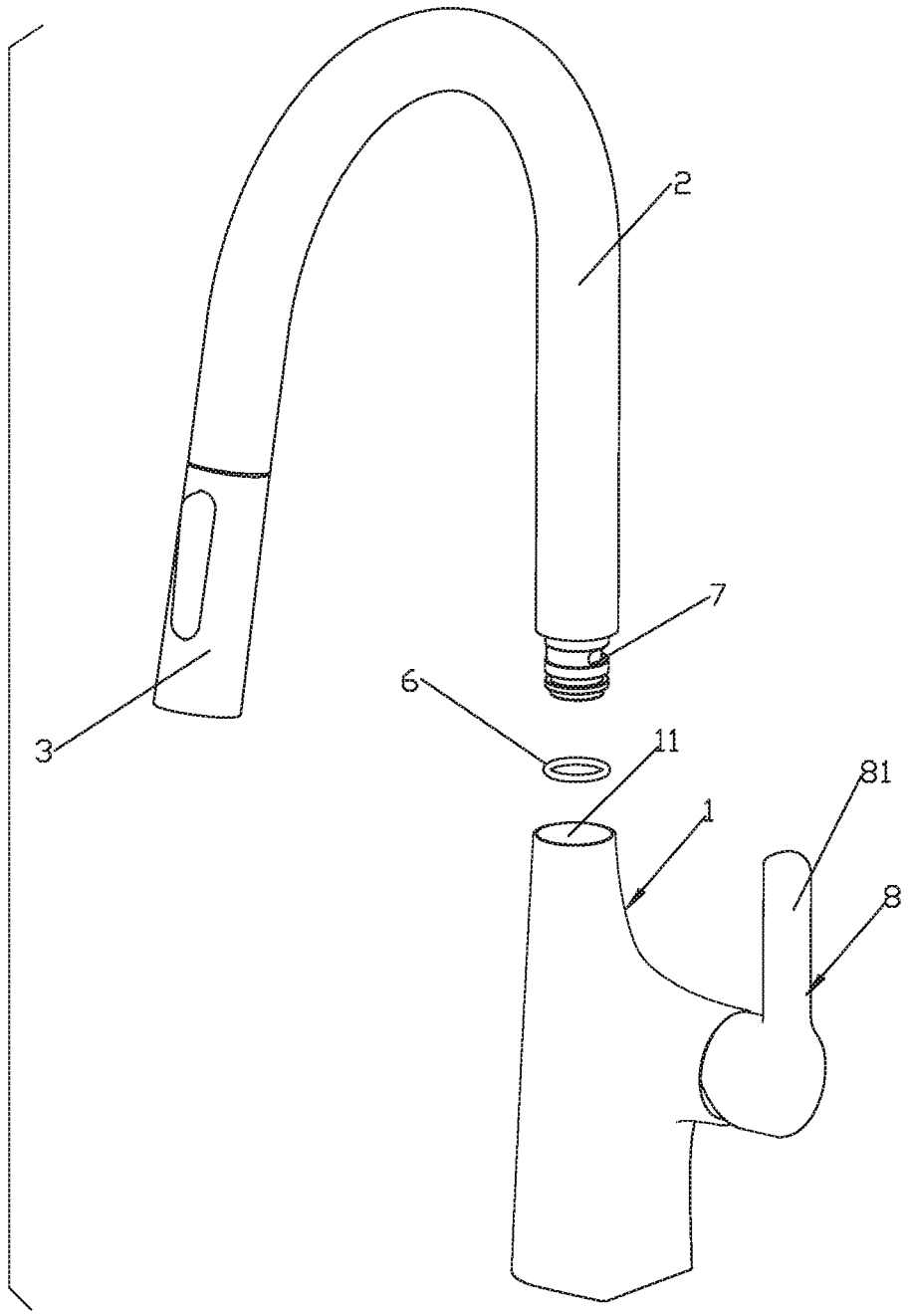
FIG. 4 illustrates a schematic diagram of the tap main body and support pipe in separating situation of the preferred embodiment of the present invention.
Figure 5:
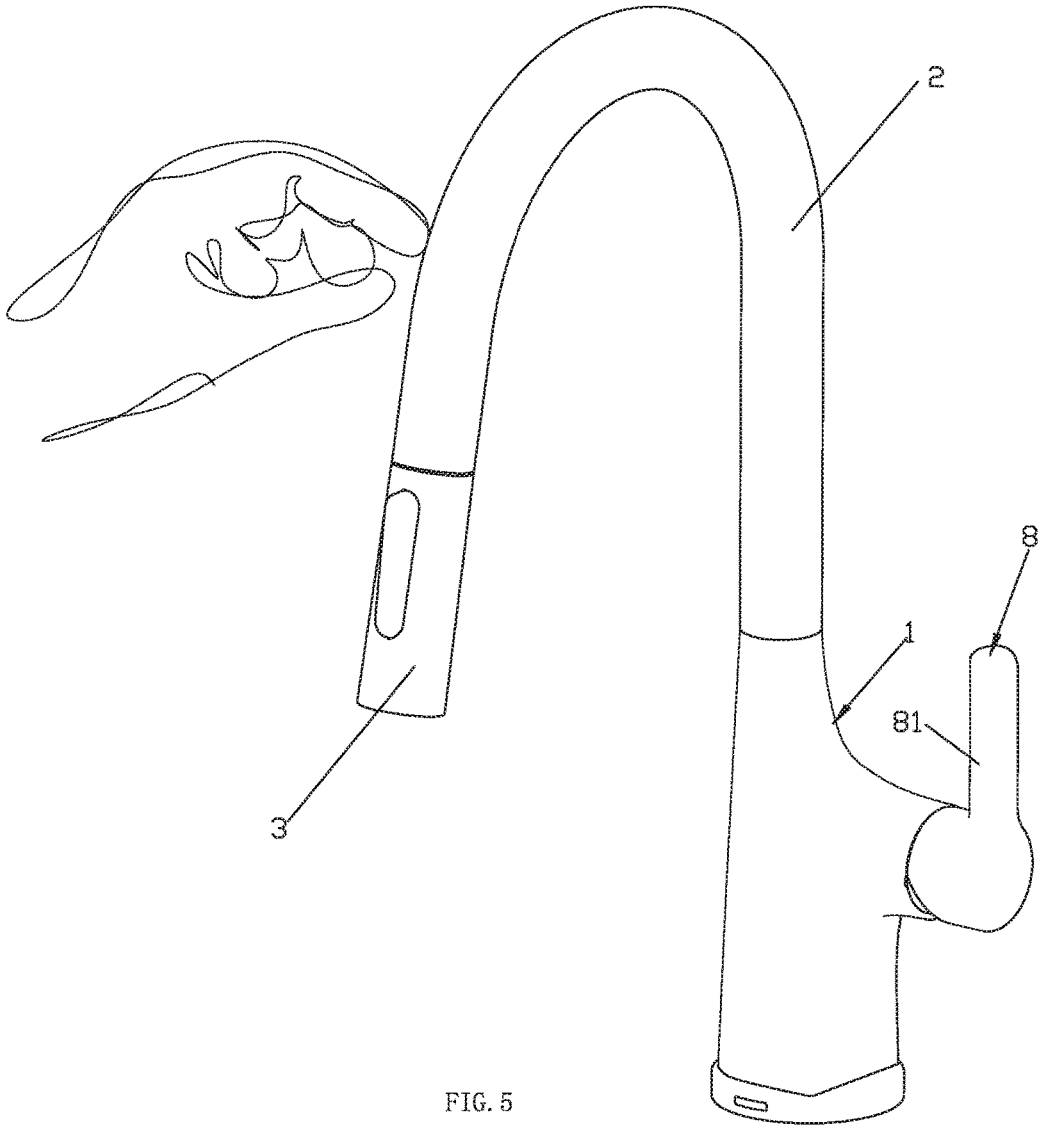
FIG. 5 is a specific application example of the preferred embodiment.

Please refer to FIGS. 1-5, the touch sensitive tap comprises a tap main body 1, a support pipe 2, an outlet portion 3, a waterway 4 and an on-off control portion 5. The tap main body 1 is made of conductive material, and it further comprises a main control valve 8 and a handle 81 controlling the main control valve 8; a hot water inlet of the main control valve 8 is connected to a hot water resource 82, a cool water inlet of the main control valve 8 is connected to a cool water resource 83, a mixing water outlet of the main control valve 8 is connected to an inlet of the on-off control portion 5 through the connecting pipe 84. The user can control the water temperature and the flow volume of the outlet mixing water through the handle 81. The structure of the main control valve 8 and the structure of the handle mentioned above can adopt the valve and handle of the current technology. The tap main body 1 is disposed with an assembly hole 11 running through the main body from up to down.

The support pipe 2 is rotatably assembled to the tap main body 1, and the support pipe 2 is made of conductive material. A connecting sleeve 7 made of conductive material is further provided; the connecting sleeve 7 is fixedly connected to one end opening of the support pipe 2 and is disposed with an extending portion, the extending portion can be inserted to the assembly hole 11 of the tap main body 1, and a certain gap is formed between the extending portion and the inner wall of the assembly hole, such that the gap enables the support pipe 2 to rotate relative to the body without hindrance. A conductive silicone ring 6 is disposed between the extending portion and the inner wall of the assembly hole 11 of the tap main body 1. The conductive silicone ring 6 is made of conductive silica gel. The conductive silicone ring 6 electrically connects the tap main body 1 and the connecting sleeve 7 of the support pipe 2, so the gap mentioned above is closed. The support pipe 2 is rotatably assembled to the tap main body 1 stably with no wobble and the conductive silicone ring 6 connects the tap main body 1 and the support pipe 2 in sealing way. The conductive silicone ring 6 electrically connects the tap main body 1 and the support pipe 2 and makes the tap main body 1 and the support pipe 2 form an integral conductor.

The on-off control portion 5 located under the tap main body 1 is coupled to the waterway 4. The on-off control portion comprises a controller and an electric control valve; the controller is signal: connected to the electric control valve to control its on-off states and then control the opening and closing of the waterway 4. The waterway 4 comprises a water pipe and the water pipe is a flexible pipe made of non-conductive material. One end of the water pipe is connected to the outlet of the on-off control portion 5, the other end passes through the assembly hole 11 of the tap main body 1 and inserts to the support pipe 2 from the end opening of the support pipe 2. The outlet portion 3 is fixedly connected to the other end opening of the support pipe 2, and is connected to the other end of the pipe.

The tap main body 1 and the support pipe 2 are made of conductive material, so the external surface of the support pipe 2 and the tap main body 1 form the touch sensing area. When the touch sensing area of the support pipe 2 is touched, a touch signal generates, and the signal is transmitted to the tap main body 1 through the conductive silicone ring 6. Then, the tap main body 1 transmits the signal to the on-off control portion 5 through a signal wire 9, for example, the controller; the touch sensing area of the tap main body 1 is touched and a touch signal generates, the signal from the tap main body 1 transmits to the on-off control portion 5 through the signal wire 9. The on-off control portion 5 turns on or turns off the waterway 4 after receiving the signal. If for example, the controller receives the signal to drive the on-off control valve to turn on or turn off the waterway 4.

In this embodiment: the conductive silicone ring 6 is provided at the connection between the tap main body and the support pipe, so it has the following technical effects: firstly, the tap main body is directly coupled to the support pipe, the tap main body and the support pipe form an integral conductor. The touch sensing area can be set on the tap main body, which increases the touch sensing area, and increases the sensitivity of the touch area of the support pipe. Thus, it can avoid the phenomenon of failure when the touch area of the support pipe is touched. The support pipe and the tap main body have the same sensitivity, so that this improves the user's sense of experience; secondly, the conductive silicone ring 6 sealingly connects the tap main body and the support pipe, which can prevent the outage of the water through a small gap between the tap main body and the support pipe from interfering with the circuit connection when users use it; thirdly, the conductive silicone ring 6 is elastic, it can eliminate the gap between the support pipe and the tap main body. It can also reduce wobble of the support pipe relative to the tap main body or avoiding wobble; fourthly, the conductive silicone ring 6 has a certain degree of elastic deformation when it is squeezed by the tap main body and the support pipe, increasing the co-area and frictional resistance, also enhancing the feel for the users.

Figure 6:
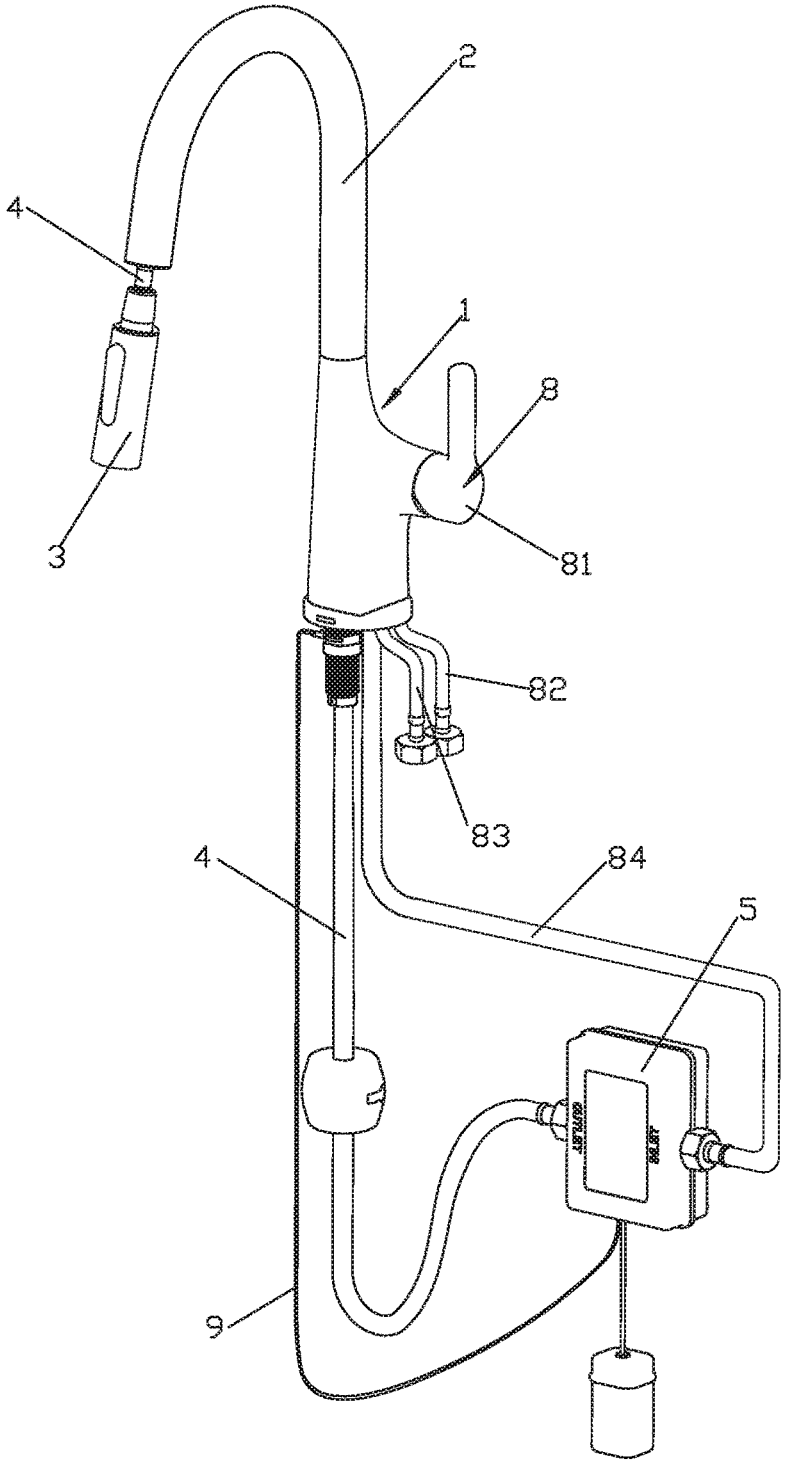
FIG. 6 illustrates a schematic diagram of a tap of another preferred embodiment of the present invention.

In other specific embodiment, it differs from the previous preferred embodiment in that: please refer to FIG. 6, the outlet portion 3 is detachably connected to the end opening of the support pipe 2, making the tap become a pull-type tap (Utilize the flexible performance of flexible water pipes, reserve the length of the flexible pipe, so the length of the flexible pipe is greater than that between one end of the connection of the support pipe and the outlet portion 3 and the outlet of the on-off control portion 5), so users can take out the outlet portion 3 from the support pipe when used, and insert it back to anther end of the support pipe 2.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A touch sensitive tap, comprising:

a tap main body;

a support pipe rotatably assembled to the tap main body and disposed with a touch sensing area for a user to touch;

a conductive silicone ring disposed between the tap main body and the support pipe to connect the tap main body and the support pipe in a sealing way and to electrically connect the tap main body and the support pipe to form an integral conductor therebetween;

an outlet portion connected to the support pipe;

a waterway at least connected from the tap main body to the support pipe and connected to the outlet portion; and an on-off control portion coupled to the waterway to control opening and closing of the waterway, wherein the integral conductor acquires a touch signal from the touch sensing area when touched by a user and transmits the touch signal to the on-off control portion, and wherein the on-off control portion controls opening and closing of the waterway after receiving the touch signal.

2. The touch sensitive tap according to claim 1, wherein the tap main body is disposed with the touch sensing area for a user to touch.

3. The touch sensitive tap according to claim 1, wherein the support pipe and the tap main body are made of conductive material, the support pipe has an external surface, and the external surface of the support pipe and the tap main body form the touch sensing area.

4. The touch sensitive tap according to claim 1, further comprising a signal wire that connects the tap main body and the on-off control portion.

5. The touch sensitive tap according to claim 1, wherein the support pipe has an end opening and the outlet portion is fixedly connected to the end opening of the support pipe.

6. The touch sensitive tap according to claim 1, further comprising a connecting sleeve made of conductive material, wherein the tap main body has defined therein an assembly hole having an internal wall, wherein the support pipe has end openings and the connecting sleeve is fixedly connected to one end opening of the support pipe and is disposed with an extending portion rotatably inserted into the assembly hole of the tap main body, and wherein the conductive silicone ring is disposed between the extending portion and the inner wall of the assembly hole of the tap main body.

7. The touch sensitive tap according to claim 6, wherein the assembly hole is a throughout hole, wherein the waterway comprises a water pipe having respective ends, one end of the water pipe being connected to an outlet of the on-off control portion, another end of the water pipe passing through the assembly hole of the tap main body and being inserted into the support pipe from one end opening thereof and connected to the outlet portion.

8. The touch sensitive tap according to claim 7, wherein the water pipe has a pipe body that is made of non-conductive material.

9. The touch sensitive tap according to claim 8, wherein the water pipe is a flexible pipe, and wherein the outlet portion is detachably assembled to another end opening of the support pipe.

10. The touch sensitive tap according to claim 1, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

11. The touch sensitive tap according to claim 2, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

12. The touch sensitive tap according to claim 3, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

13. The touch sensitive tap according to claim 4, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

14. The touch sensitive tap according to claim 5, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

15. The touch sensitive tap according to claim 6, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

16. The touch sensitive tap according to claim 7, wherein the tap main body further comprises a main control valve; and a handle controlling the main control valve, and wherein hot water inlet of the main control valve has a hot water inlet connected to a hot water resource, a cool water inlet connected to a cool water resource, and a mixing water outlet connected to an inlet of the on-off control portion.

17. The touch sensitive tap according to claim 8, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

18. The touch sensitive tap according to claim 9, wherein the tap main body further comprises a main control valve; and a handle controlling the main control valve, and wherein the main control valve has a hot water inlet connected to a hot water resource, a cool water inlet connected to a cool water resource, and a mixing water outlet connected to an inlet of the on-off control portion.

* * * * *